US012653304B2

(12) United States Patent
Davis

(10) Patent No.: US 12,653,304 B2
(45) Date of Patent: Jun. 16, 2026

(54) OVER BED TABLE WITH IMPROVED BASE

(71) Applicant: Industrial Woodworking Corporation, Zeeland, MI (US)

(72) Inventor: Bradford L. Davis, Holland, MI (US)

(73) Assignee: Industrial Woodworking Corporation, Zeeland, MI (US)

( * ) Notice: Subject to any disclaimer, the term of this patent is extended or adjusted under 35 U.S.C. 154(b) by 87 days.

(21) Appl. No.: 18/603,678

(22) Filed: Mar. 13, 2024

(65) Prior Publication Data

US 2024/0365973 A1 Nov. 7, 2024

Related U.S. Application Data

(63) Continuation-in-part of application No. 29/891,161, filed on May 2, 2023, now Pat. No. Des. 1,071,597.

(51) Int. Cl.
*A47B 23/04* (2006.01)
*A47B 9/20* (2006.01)

(52) U.S. Cl.
CPC ..... *A47B 23/046* (2013.01); *A47B 9/20* (2013.01)

(58) Field of Classification Search
CPC . A47B 23/00; A47B 23/046; A47B 2023/048; A47B 2200/0026; A47B 2200/0033; A47B 31/00

(Continued)

(56) References Cited

U.S. PATENT DOCUMENTS 529,210 A 11/1894 Storz et al.
1,079,487 A 11/1913 Hasenzahl (Continued)

FOREIGN PATENT DOCUMENTS

CN 302330854 2/2013
CN 302330985 2/2013

(Continued)

OTHER PUBLICATIONS

Invacare Hospital Style Overbed Table ("Invacare"), available on Amazon.com, date first available May 2, 2004 [online], [retrieved Dec. 1, 2022] Available from internet URL: https://www.amazon.com/Invacare-Overbed-Height-Adjustable-6418/dp/B000C4QFTY?source=ps-sl-shoppingads-lpcontext&ref_=fplfs&smid=AFF (Year: 2004).

(Continued)

*Primary Examiner* — Janet M Wilkens
*Assistant Examiner* — Elizabeth Irene Artalejo
(74) *Attorney, Agent, or Firm* — Warner Norcross + Judd LLP

(57) ABSTRACT

A base for an over bed table ("OBT") optimized for use with both retractable under-bed wheel(s) and corner structures (e.g. legs/corner wheels). The base includes a column-support portion and a wishbone-shaped extension configured to pass under the bed when the OBT is in use. The wishbone-shaped extension has a U-shaped portion with a profile low enough to pass below raised under-bed wheels, thereby allowing interference-free movement of the base under much of the bed. The wishbone configuration also facilitates movement of the base adjacent to and about the corner structures. For example, the unique shape provides lateral gaps on opposite sides of the base that allow the OBT to be moved farther into the corners of the bed before the base encounters interference from the corner structures, as well as a large central opening that allow the base to deeply straddle corner structures.

18 Claims, 8 Drawing Sheets

(58) Field of Classification Search
USPC ..... 108/49, 177, 147.19; 248/129, 152, 174, 248/247, 300; 16/24, 45
See application file for complete search history.

(56) References Cited

U.S. PATENT DOCUMENTS

| | | | | |
|---|---|---|---|---|
| 1,916,537 | A | 7/1933 | Smith | |
| D132,427 | S | 5/1942 | Hillenbrand | |
| D135,341 | S | 3/1943 | Hillenbrand | |
| 2,329,902 | A | 9/1943 | Hillenbrand | |
| 2,357,588 | A | 9/1944 | Hillenbrand | |
| D169,460 | S | 4/1953 | Smith | |
| 2,685,487 | A | 8/1954 | Woller | |
| D190,082 | S | 4/1961 | Chervenka | |
| D198,168 | S | 5/1964 | Armstrong | |
| 3,188,986 | A | 6/1965 | Vigne | |
| 3,286,663 | A | 11/1966 | Mann et al. | |
| 3,314,384 | A | 4/1967 | Mann et al. | |
| 3,525,492 | A | 8/1970 | Friedman et al. | |
| 3,669,392 | A | 6/1972 | Saunders | |
| 3,999,492 | A | 12/1976 | Emrick | |
| 4,077,333 | A | 3/1978 | Ballas | |
| 4,401,036 | A | 8/1983 | Russo | |
| D270,588 | S | 9/1983 | Kemple | |
| D281,297 | S | 11/1985 | Esslinger | |
| 4,922,836 | A | 5/1990 | Damico | |
| 5,144,898 | A | 9/1992 | Posly | |
| D366,781 | S | 2/1996 | Cartwright | |
| 5,775,234 | A | 7/1998 | Solomon et al. | |
| D428,732 | S | 8/2000 | Roddan | |
| 6,327,982 | B1 | 12/2001 | Jackson | |
| 6,484,648 | B1 | 11/2002 | Long | |
| D467,754 | S | 12/2002 | Chen | |
| 6,615,744 | B1 | 9/2003 | Eckstein et al. | |
| 7,104,201 | B2 | 9/2006 | Comeaux et al. | |
| 7,540,243 | B2 | 6/2009 | George et al. | |
| D612,169 | S | 3/2010 | Chang | |
| D638,637 | S | 5/2011 | Foley | |
| 8,100,061 | B2 | 1/2012 | Hookway et al. | |
| 8,104,620 | B2 * | 1/2012 | Lin | B03C 1/08 15/1 |
| D654,294 | S | 2/2012 | Davis | |
| 8,316,777 | B1 | 11/2012 | Rosing | |
| 8,613,454 | B2 | 12/2013 | Foley | |
| 8,677,528 | B2 * | 3/2014 | Hookway | A47B 23/046 5/503.1 |
| D731,216 | S | 6/2015 | Sorel | |
| D731,221 | S | 6/2015 | Hosoya | |
| 9,149,111 | B1 | 10/2015 | Lin | |
| D774,322 | S | 12/2016 | Schmauch et al. | |
| D774,810 | S | 12/2016 | Biddle et al. | |
| D778,645 | S | 2/2017 | Merritt | |
| 9,642,455 | B1 | 5/2017 | Albert | |
| 9,993,076 | B2 | 6/2018 | Harrington et al. | |
| D834,852 | S | 12/2018 | Davis | |
| D882,997 | S | 5/2020 | Powell et al. | |
| 11,412,841 | B2 | 8/2022 | Leng | |
| 2004/0163574 | A1 | 8/2004 | Schoenbach et al. | |
| 2005/0132935 | A1 | 6/2005 | Lahmann et al. | |
| 2009/0266274 | A1 | 10/2009 | Berlin et al. | |
| 2011/0175506 | A1 | 7/2011 | Davis | |
| 2011/0197796 | A1 | 8/2011 | Bhave et al. | |
| 2015/0173507 | A1 | 6/2015 | Cardon | |
| 2015/0257528 | A1 | 9/2015 | Rosing | |
| 2016/0331134 | A1 | 11/2016 | Harrington et al. | |
| 2020/0100591 | A1 | 4/2020 | Simmons | |
| 2022/0232969 | A1 * | 7/2022 | Davis | A47B 23/046 |
| 2023/0248141 | A1 | 8/2023 | Davis | |

FOREIGN PATENT DOCUMENTS

| | | | |
|---|---|---|---|
| CN | 306888531 | 10/2021 | |
| CN | 307306015 | 5/2022 | |
| RU | 00043524 | 6/1997 | |
| WO | 2004098351 | 11/2004 | |
| WO | WO-2004098351 A1 * | 11/2004 | A47B 23/046 |

OTHER PUBLICATIONS

Paramount Bed Side Table KF-1930 ("Paramount"), available on Amazon.com, date first available Dec. 25, 2015 [online], [retrieved Dec. 6, 2022] Available from internet URL: https://www.amazon.com.jp/-/en/Paramount-Side-Table-KF-1930-Medium/dp/B019T5KYVG?th=1 (Year: 2015).

* cited by examiner

OVER BED TABLE WITH IMPROVED BASE

BACKGROUND OF THE INVENTION

The present invention relates to over bed tables ("OBT"), and more specifically to bases for OBTs.

Over bed tables are in widespread use in hospitals and other patient care facilities where patients are rest or are treated in beds. As the name implies, OBTs provide a table that can be removable situated over a patient's bed to provide the patient with a work surface when desired. Conventional OBTs include a base, a column that extends upwardly from a location near one end of the base and a work surface that is mounted to the top of the column and extends in a cantilevered manner back over the base. To allow the OBT to be easily moved over the floor, the base is typically supported on the floor upon casters, wheels, glides or other low friction components. With this configuration, the OBT can be easily movable into position from the side of the patient's bed with the work surface extending over the bed and the base extending under the bed.

While OBTs are ubiquitous and are used in nearly all hospital and patient care environments, many patient beds are configured in a way that interferes with free movement of the OBT base under the bed. More specifically, some of the most commonly used hospital and other patient beds have underbed structures that create extremely low underbed clearance. This low clearance is due to the overall form and function of these beds and may be caused by various underbed structures, but of particular concern is the use of OBTs with patient beds that have a "5th wheel" or "drive wheels". In these types of patient beds, there is a "5th wheel" located either in the center or close to the center of the bed or two drive wheels somewhere in-between the four casters located on or about the four corners of the bed. In all of these configurations, the 5th wheel or drive wheels (collectively referred to as "under-bed wheels") are intended for use during patient transport only to make the transport easier on the staff by using the wheels as a fulcrum when turning corners etc. As a result, under-bed wheels are typically configured to be raised and lowered. When a patient is being transported in the patient bed, the under-bed wheels are lowered to the ground for use. However, when a patient is in their room, the 5th wheel or drive wheels are disengaged and lifted off the floor so the four primary casters can sit evenly and level with the floor. Although under-bed wheel specifications vary from bed to bed, even when raised, under-bed wheels can have as little as 1" of clearance from the bottom of the under-bed wheel to the floor.

As a result of the limited clearance, many conventional OBT offerings do not work well with patient beds that incorporate under-bed wheels. As noted above, conventional OBT offerings include a base that is fitted under the patient bed when the OBT is moved into position for use over the patient bed. Many current OBT base offerings run into the 5th wheel or the drive wheels even when raised. Further, the placement of these under-bed wheels make the use of OBTs almost impossible, and in many cases the OBTs purchased do not work at all. The reason for this is that the base of the OBT must be placed either fore or aft of the under-bed wheel(s), this creates the issue of the OBT top being either too close to the patient or too far away to be comfortably used.

Conventional OBTs have a variety of different base configuration. For example, some bases are U-shaped, with the opening of the "U" facing toward the patient bed. Other bases are H-shaped with the openings in the "H" facing fore and aft. Still other bases are C-shaped and can be oriented with the opening of the "C" facing fore or aft. None of these configurations work well with patient beds that include under-bed wheels. If a U-shaped base is used, the OBT can be positioned fore or aft of the under-bed wheels or so that the legs straddle the under-bed wheels. Positioning the base fore of the under-bed wheels limits movement of the OBT in the aft direction, which is likely to cause the OBT to be too close to the patient. Positioning the base aft of the under-bed wheels limits movement of the OBT in the fore direction, which is likely to cause the OBT to be too far from the patient. Positioning the base to straddle the under-bed wheels will capture the under-bed wheels between the legs and severely limit fore and aft movement of the OBT. If an H-shaped base configuration is used, the OBT must be positioned so that the inner end of the "H" is not aligned with any under-bed wheels (e.g. fore or aft of the under-wheels) before the OBT can be moved into position over the bed. Once the OBT has been pushed into position, it can be moved fore or aft until the base abuts the under-bed wheels. Although the "H" configuration allows a bit more movement in the fore and aft position than a U-shape base, an H-shaped base can create issues in a "Crash" situation when the patient is coding (life or death emergency situation) when the base is positioned so that the under-bed wheels are positioned with the one of the openings in the "H". In the rush and frenzy to save the patient, the OBT base can become entangled with the 5th or drive wheels when seconds count. A C-shaped base suffers from much the same issues as the H-shaped base. Fore and aft movement of the OBT along the bed is limited by the under-bed wheels and the under-bed wheels can become entangled in the opening of the "C", thereby making it difficult to remove the OBT from the patient bed in emergency situations. Hospitals know this full well so OBTs with H-shaped and C-shaped bases are generally not used with these patient beds having under-bed wheels.

At least one commercially available OBT is available with an extremely low-profile base configured to pass beneath the under-bed wheel(s). For example, one commercially available OBT include a base with a generally Y-shaped structure that passes under the bed. The Y-shaped base has a low-profile that is configured to pass under raised under-bed wheels. While this configuration improves interaction with under-bed wheels, the inner end of the Y-shaped base will abut with corner legs/corner wheels that are in contact with the ground, which can interfere with positioning the OBT at the head or foot of the bed. For example, if an effort is made to move the base under the bed at one of the corner structures. The base will rather quickly abut the corner structure.

As a result of the foregoing, there remains room for improvement in the field of OBTs, including a long-felt and unmet need for an OBT with a base that provides improved performance not only with retractable under-bed wheels, but also with legs/corner wheels of patient beds.

SUMMARY OF THE INVENTION

The present invention provides an over bed table ("OBT") with a base configured for use with patient beds having retractable under-bed wheels or other under-bed structures with low clearance. The OBT includes a base, a column extending upwardly from one end of the base and a table top mounted atop the column and extending in a cantilevered manner over the base. The base includes an elevated column-support portion and a low-profile wishbone-shaped extension. The wishbone-shaped extension generally includes a U-shaped primary portion that is joined to the column-support portion by a transition segment. The primary portion of the wishbone-shaped extension extends through a horizontal plane that has a low enough profile to pass below raised under-bed wheels. For example, the upper surface of the primary portion may be no more than about ¾ inch from the floor. The U-shaped primary portion terminates at opposite ends in elevated caster support segments. The base is supported upon a pair of primary casters extending from the undersurface of the elevated column-support portion and a pair of secondary casters extending from the undersurfaces of the elevated caster support ends.

In one embodiment, the column-support portion is generally T-shaped with a lateral segment and a longitudinal segment. The column is mounted near the intersection of the lateral segment and the longitudinal segment. Primary casters are mounted toward opposite ends of the lateral segment. In one embodiment, the lateral and longitudinal segments extend through a common horizontal plane that is high enough from the floor to accommodate the desired casters. In one embodiment, the wishbone shape results in gaps in the base that allow a fully inserted OBT to be moved closer to under-bed structures that do not have any clearance, such as legs and corner wheels.

In one embodiment, the wishbone-shaped extension is joined to the longitudinal segment of the column-support portion. For example, the transition segment of the wishbone-shaped extension may be joined to the longitudinal segment of the column-support portion. The transition segment may extend at an angle to bridge the vertical offset between the column-support portion and the primary segment of the wishbone-shaped portion. The transition segment may extend at an angle of approximately 45 degrees relative to a horizontal plane, but the angle may vary from application to application, for example, may extend at an angle of between about 15 degrees and about 90 degrees.

In one embodiment, the longitudinal segment of the column-support portion and the transition segment are configured to provide substantial lateral gaps between the lateral segment of the column-support portion and the U-shaped portion on both sides of the base. These gaps are configured to be large enough to accommodate a corner leg or corner wheel of the patient bed, which permits a fully inserted OBT to be moved to the head or foot of the patient bed without interference from the corner leg or corner wheels. The size of the lateral gaps is selected to provide enough clearance to receive a corner leg/wheel when the OBT is fully inserted, and preferably not much larger than needed to provide this function so that the U-shaped portion has greater depth. This helps to maximize the depth to which the U-shaped portion can receive ground engaging structures, such as corner legs/wheels and under-bed wheel that have not been fully raised.

In one embodiment, the base includes a support rib that extends vertically from the transition segment and the U-shaped portion. The support rib may be generally triangular and may be welded in place to the transition segment and to one or more adjacent segments of the base. The support rib provides structural reinforcement that stiffens the connection between the transition segment and the U-shaped portion. The support rib helps to reinforce the base against bouncing in response to the application of weight to the table top.

In one embodiment, the U-shaped portion of the wishbone extension includes a curved segment that follows a generally semicircular arc centered on the lateral segment of the column-support portion and a pair of linear segments that extend from opposite ends of the curved segment. The curved segment provide an interface surface that helps to guide the OBT away from under-bed structures, such as corner wheels or legs, that might be engaged by the OBT as it is moved around under the bed.

In one embodiment, the base is configured so that when the OBT is fully inserted under the patient bed (e.g. until the column is adjacent the side of the bed), the secondary caster segments are positioned inwardly under the bed beyond and offset from the under-bed wheel(s) such that the fully inserted OBT can be moved forward and rearwardly along the patient bed without the secondary caster segments abutting the under-bed wheel(s).

In one embodiment, the base is assembled from a number of separate components that are formed from sheet stock blanks. The components may be separated so as to reduce waste in the sheet stock. For example, the base may be formed primarily from three separate blanks, including a "T"-shaped blank that forms the column-support portion and the longitudinal center of the base, and a pair of mirror image blanks that form the curved arms of the wishbone-shaped extension. The base is manufactured by cutting the blanks from plate or sheet stock, stamping the blanks to bend them into the finished shape and then welding together the three formed blanks. Alternatively, the column-support portion and the wishbone-shaped extension can be of a one-piece unitary structure.

The present invention provides a base for an OBT table that is specially configured to facilitate use with not only with retractable under-bed wheels, such as 5th wheels or drive wheels, but also with corner structures, such as legs and corner wheels, that generally remain in contact with the ground and have no under-clearance. The low profile region of the U-shaped segment is configured to pass below a raised under-bed wheel and other similar under-bed structures. Once the OBT has been fully inserted into place over the patient bed, the OBT can be moved fore and aft along the bed without interference from the under-bed wheels. Further, the wishbone-shaped extension cooperates with the column-support portion to create lateral gaps on both sides of the base that allow the base of an inserted OBT to straddle corner structures (such as corner legs and corner wheels) even when those corner structures are in contact with the floor and have no clearance. These means that OBT can be moved farther toward the head and foot of the bed before interference from the corner structures. The curved segment of the wishbone-shaped extension helps to facilitate movement of the OBT with respect to the corner structures. More specifically, the curved edge may abut the corner structure and help to guide the base around the corner structure during insertion and removal of the base. This can be particularly helpful in emergency situations when it is important to remove the OBT from beneath the patient bed as quickly as possible. Further, in some implementations, the support gusset(s) or rib(s) helps to meaningfully improve the rigidity and stability of the base, reducing the tendency for the table top to sag and/or bounce during use. For example, in one illustrated embodiment, a single support rib strengthens the primary transition segment particularly with respect to the U-shaped segment, and in another illustrated embodiment, a pair of support ribs strengthen the primary transition segment particularly with respect to the longitudinal segment of the column-support portion.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Overview of Illustrated Embodiment

Figure 2:
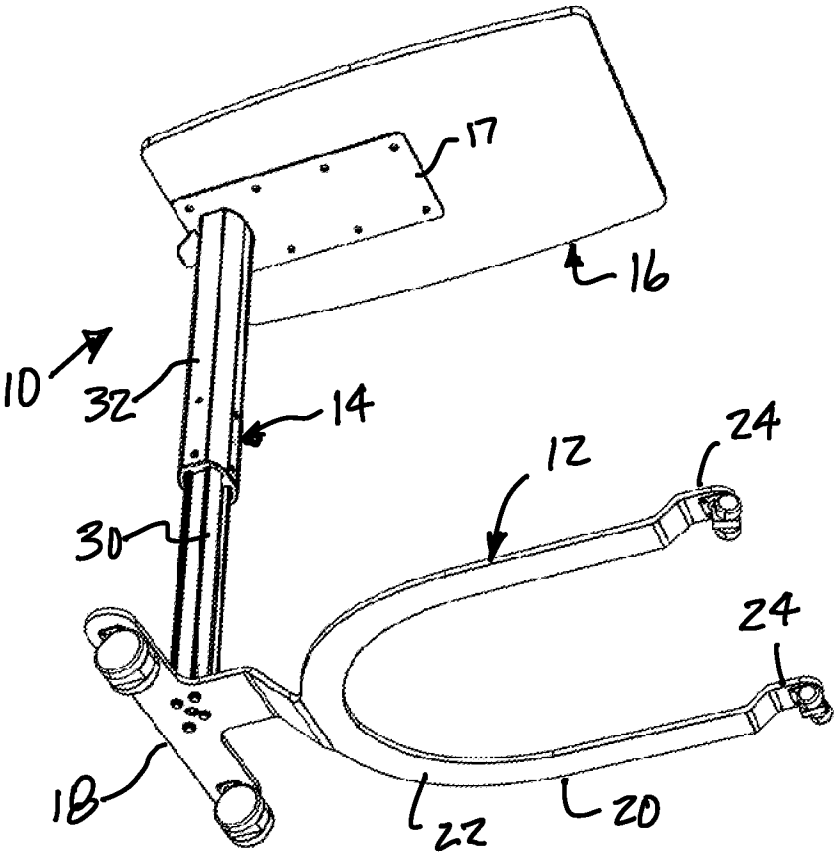
FIG. 2 is a bottom perspective view of the OBT.
Figure 1:
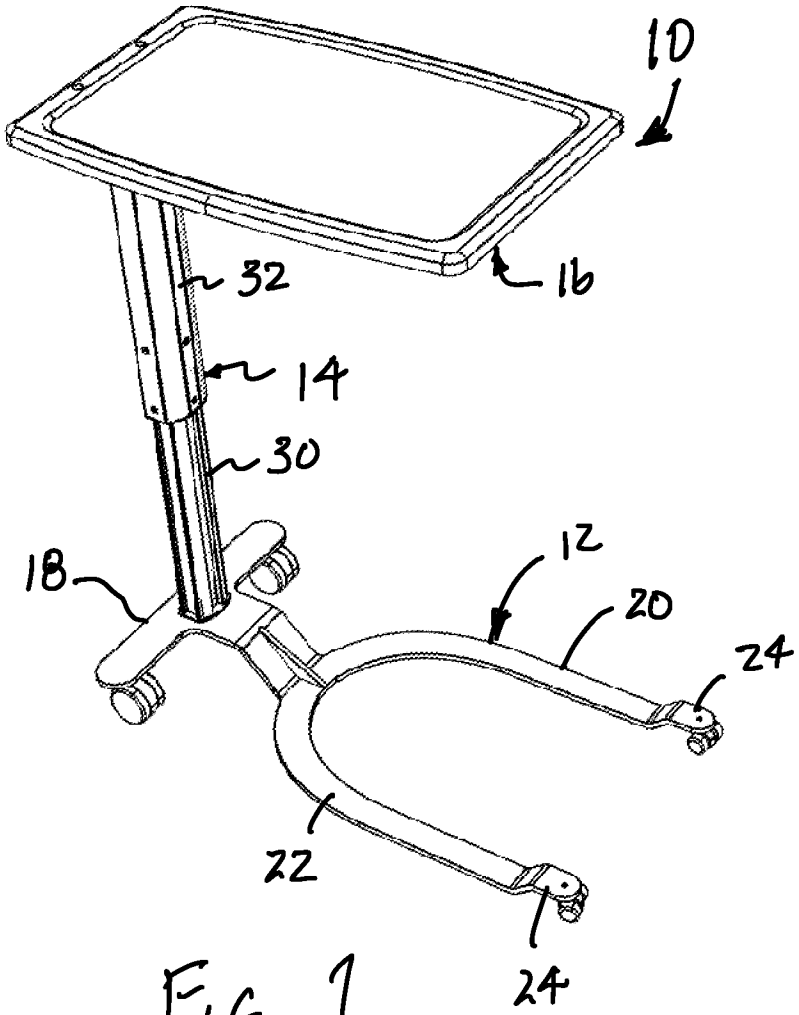
FIG. 1 is a top perspective view of an over bed table ("OBT") having a wishbone base in accordance with an embodiment of the present invention.
Figure 3:
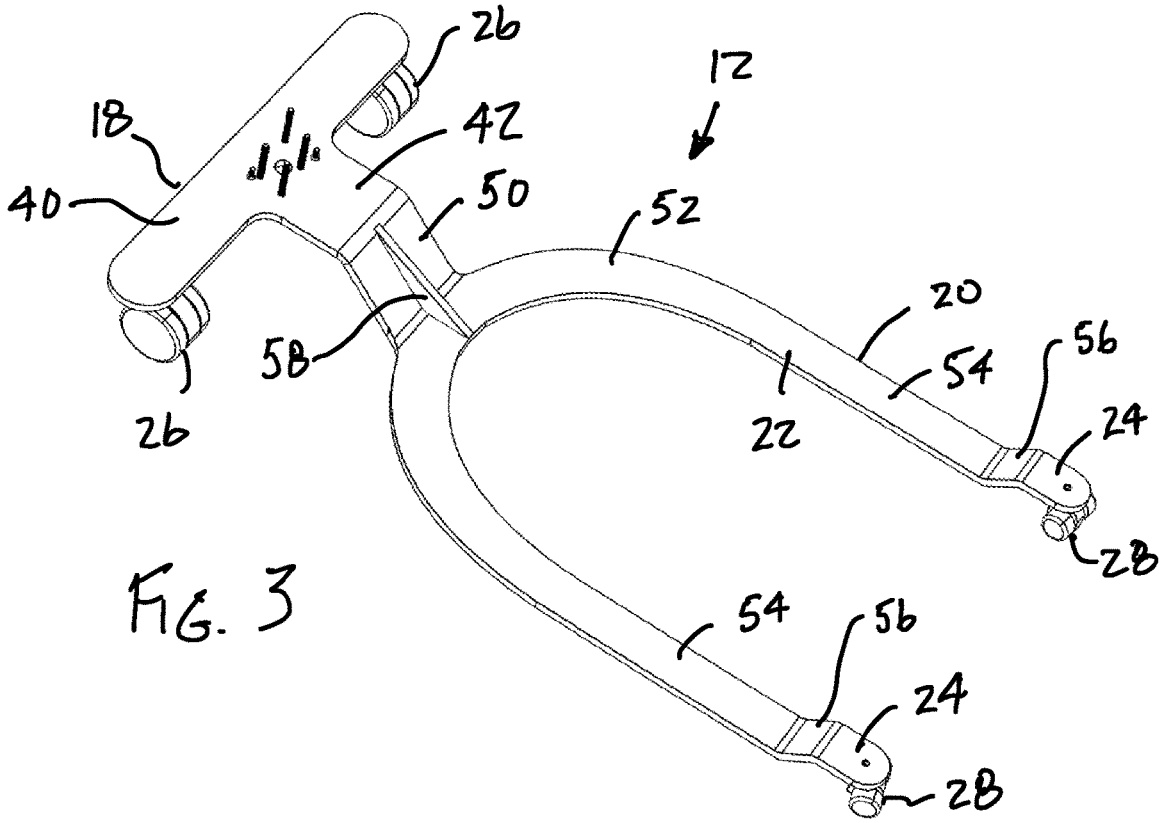
FIG. 3 is a right side view of the OBT.
Figure 4:
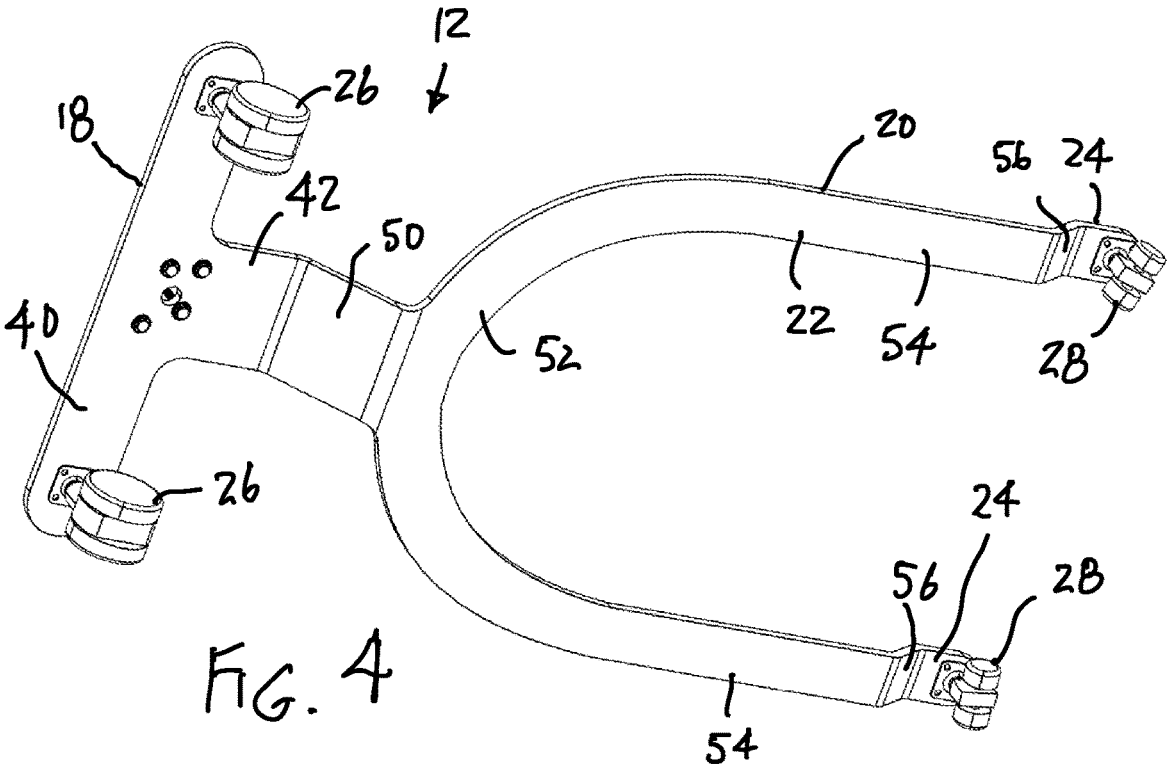
FIG. 4 is a top perspective view of the base.
Figure 5:
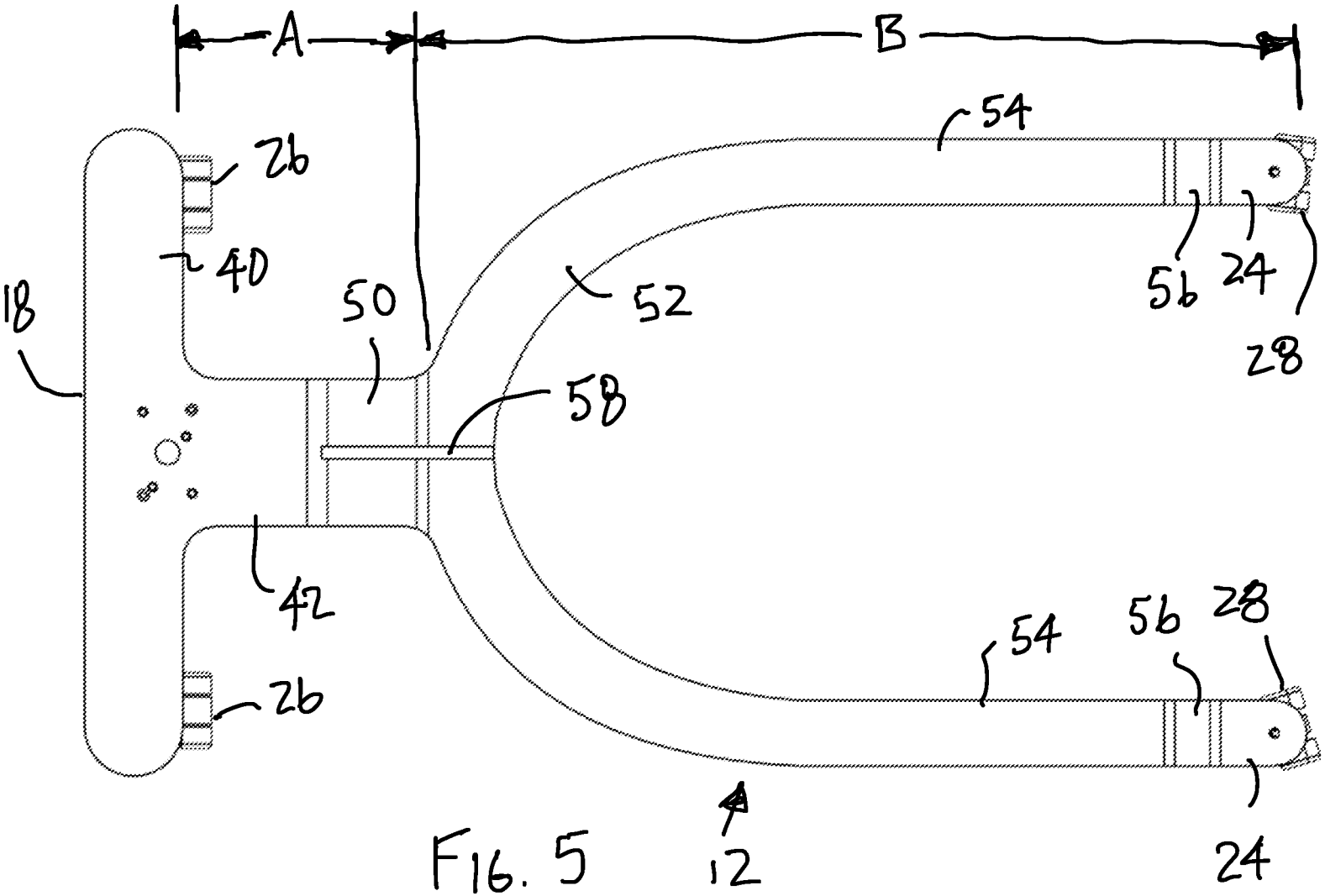
FIG. 5 is a top plan view of the base.
Figure 6:
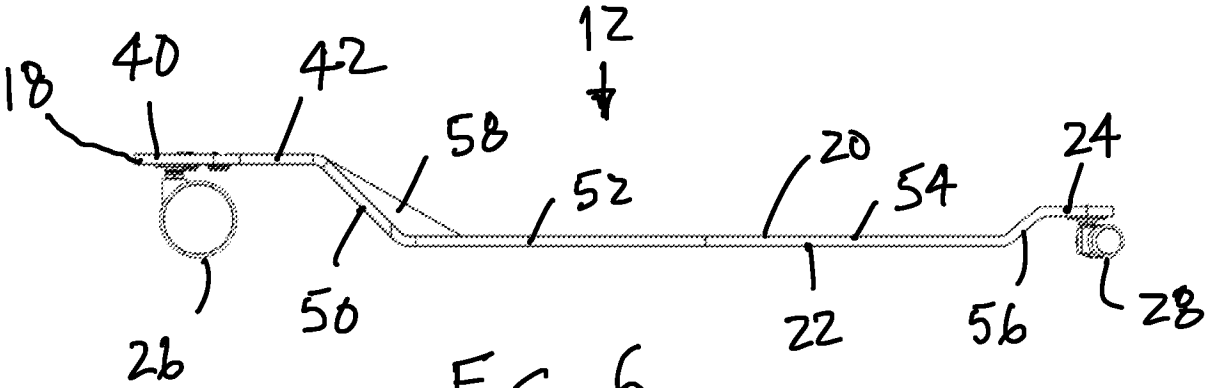
FIG. 6 is a right side view of the base
Figure 7:
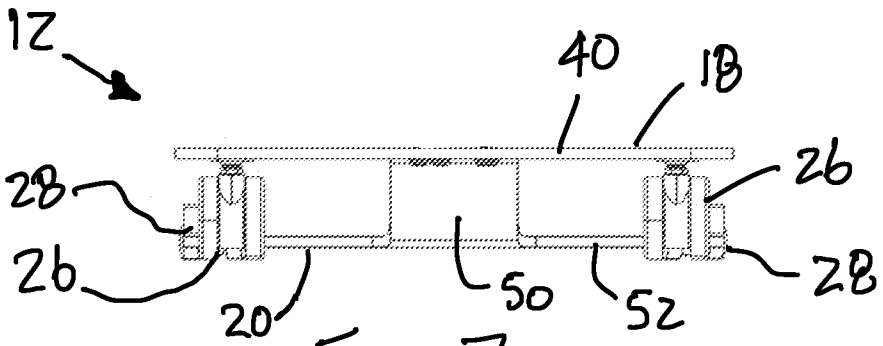
FIG. 7 is a front view of the base.

A current embodiment of an over bed table ("OBT") having a wishbone base in accordance with an embodiment of the present invention is show in FIGS. 1-7 and generally designated 10. The OBT 10 includes a base 12 that is specially configured for use with hospital and other patient beds that have retractable under-bed wheels, such as $5^{th}$ wheels or drive wheels (See, e.g. FIG. 9), as well as corner structures, such as legs and corner wheels, that might create clearance issues or otherwise interfere with movement of the OBT 10 relative to the bed. Referring now to FIGS. 1 and 2, OBT 10 generally includes a base 12, a column 14 and a table top 16. As shown, the column 14 is position toward one end of the base 12 and extend upwardly to support the table top 16. The table top 16 is mounted upon and extends from the column 14 over the base 12 in a cantilevered configuration. In the illustrated embodiment, the base 12 includes a column-support portion 18 and a wishbone-shaped extension 20. The column-support portion 18 is elevated to accommodate primary casters 26. The wishbone-shaped extension 20 includes a U-shaped portion 22 that extends through a plane close to the floor and generally has a low enough profile to pass under raised under-bed wheel(s) W. The U-shaped portions terminates in a pair of secondary caster segments 24 that are elevated to accommodate secondary casters 28. The base 12 is configured so that, in use, the U-shaped portion 20 can be fitted under the patient bed while the elevated column-support portion 18 and the column 14 remain out from beneath the bed. The wishbone configuration of the base 12 provides the OBT with an optimized balance between strength, stability and underbed clearance—not only with respect to the under-bed wheels and other under-bed structures, but also with respect to other bed structures, such as legs and corner wheels, that are typically engaged with the floor and therefore have no clearance.

Over Bed Table.

An exemplary embodiment of the present invention will now be described in more detail with reference to FIGS. 1-10. As noted above, the present invention provides base 12 for an over bed table 10 ("OBT"). The base 12 is specially configured for use with patient beds having retractable under-bed wheels and other under-bed structures that provide limited clearance. For purposes of disclosure, the base 12 is described in the context of an OBT 10 having a table top mounted to an adjustable-height column (See FIGS. 1 and 2). The OBT 10 shown and described herein is merely exemplary and OBT bases in accordance with the present invention can be incorporated into OBTs of essentially any design and configuration with different columns and different tops.

Referring again to FIG. 1, the OBT 10 generally includes base 12, column 14 and table top 16. In this embodiment, the column 14 is a conventional telescopic column including a lower section 30 that is secured to the base 12 and an upper section 32 that is secured to the table top 16. The upper section 32 is telescopically fitted over the lower section 30 and can be moved vertically relative to the lower section 30 to vary the height of the table top 16. A wide range of telescopic columns are available on the market. The present invention may be incorporated into OBTs that do not include a telescopic column. For example, the column may be of fixed length or may be extended and retracted through arrangements other than telescopic arrangements.

As shown in FIGS. 1 and 2, the table top 16 is mounted atop the column 14 in a cantilevered arrangement. As shown, the table top 16 extends from the column 14 approximately parallel to the general longitudinal extent of the base 12. In this embodiment, a table top mounting plate 17 is affixed to the top of the column 14 and the table top 16 is affixed to the mounting plate 17, for example, by screws. The illustrated table top 16 is merely exemplary and the OBT may be fitted with a wide range of alternative table tops, including table tops that present a work surface and others that include one or more drawers, shelves and/or other features and accessories.

Referring now to FIGS. 3-7, the base 12 of the illustrated embodiment generally includes a column-support portion 18 and a wishbone-shaped extension 20. The column-support portion 18 of the illustrated embodiment is generally T-shaped with a lateral segment 40 and a longitudinal segment 42. The lateral segment 40 extends laterally across the width of the OBT and is supported primary casters 26. The longitudinal segment 42 extends from the approximate center of the lateral segment 40. In this embodiment, the lateral segment 40 and the longitudinal segment 42 extend through a common horizontal plane, though the two segments need not be strictly planar or strictly horizontal. As shown, the column support portion 18 is elevated to accommodate the underlying primary casters 26. In the illustrated embodiment, the column 14 is mounted to the upper surface of the column-support portion 18 proximate the intersection of the lateral segment 40 and the longitudinal segment 42. The column 14 may be coupled to the base 12 by any suitable method. For example, the column 14 may be welded or attached by fasteners to the column-support portion 18.

In the illustrated embodiment, the wishbone-shaped extension 20 extends from the column-support portion 18 in a longitudinal direction generally underlying the table top 16. For example, the wishbone-shaped extension 20 may extend from the end of the longitudinal segment 42 of the column-support portion 18. In the illustrated embodiment, the base 12 is assembled from several component parts that are joined together, for example, by welding (discussed in more detail below with reference to FIG. 13). In alternative embodiments, the base 12 may be of a generally one-piece, unitary construction, excluding only the primary and secondary casters and the support rib (as described elsewhere herein).

The wishbone-shaped extension 20 generally includes a transition segment 50 and U-shaped portion 22. In this embodiment, the transition segment 50 extends longitudinally and joins the U-shaped portion 22 to the column-support portion 18. As shown, the transition segment 50 may extend from the longitudinal segment 42 of the column-support portion 18. The transition segment 50 of the illustrated embodiment extends at an angle to bridge the vertical offset between the elevated column-support portion 18 and the low-profile U-shaped portion 22. The illustrated transition segment 50 extends at an angle of approximately 45 degrees relative to a horizontal plane, but the angle may vary from application to application, for example, may extend at an angle of between about 15 degrees and about 90 degrees. The transition segment 50 need not be planar and may bridge the vertical offset using essentially any suitable shape. In alternative applications, the longitudinal segment 42 of the column-support portion 18 be angled (alone or in combination with the transition segment 50) to bridge the vertical offset.

In the illustrated embodiment, the U-shaped portion 22 generally includes a curved segment 52, a pair of linear segments 54 and a pair of secondary caster segments 24. The precise shape of the curved segment 52 may vary from application to application, but the curved segment of the illustrated embodiment is a semicircular arc with a constant curvature of radius. In this embodiment, the curved segment 52 is centered on the transition segment 50. In other applications, the curved segment 52 may have variations in radius and/or have a combination of regions that are linear or have different radiuses of curvature. The linear segments 54 extend from opposite ends of the curved segment 52. As shown, the linear segments 54 extend generally parallel to one another, though they may be askew in alternative applications. In the illustrated embodiment, the linear segments 54 terminate in secondary caster segments 24. The secondary caster segments 24 are elevated to accommodate secondary casters 28. The secondary casters 28 of the illustrated embodiment have a lower profile than the primary casters 26, but the relative sizes of the primary and secondary casters may vary from application to application. For example, the primary and secondary casters may be of the same size or have other differences in size. To account for the height difference between the secondary caster segments 24 and the linear segments 54, the secondary caster segments 56 may include secondary transition segments 56. The size, shape and configuration of the secondary transition segments 56 may vary from application to application, but in the illustrated embodiment, the secondary transition segments 56 are generally planar and extend at an angle of about 45 degrees or at an angle in the range of about 5 degrees to about 90 degrees.

The U-shaped portion 22 includes a low profile region that generally extends through a horizontal plane situated close to the floor so that it has a low enough profile to pass under raised under-bed wheel(s) W and other under-bed structures that might present reduced clearance. For example, the low profile region (which includes the curved segment 52 and the linear segments 54 in the illustrated embodiment, but excludes the secondary transition segments 56 and secondary caster segments 24) may have an upper surface that is no more than ¾, ⅞ or 1 inch from the floor and a bottom surface that is no more/less ¼, ⅜ or ½ inch from the floor.

Figure 11:
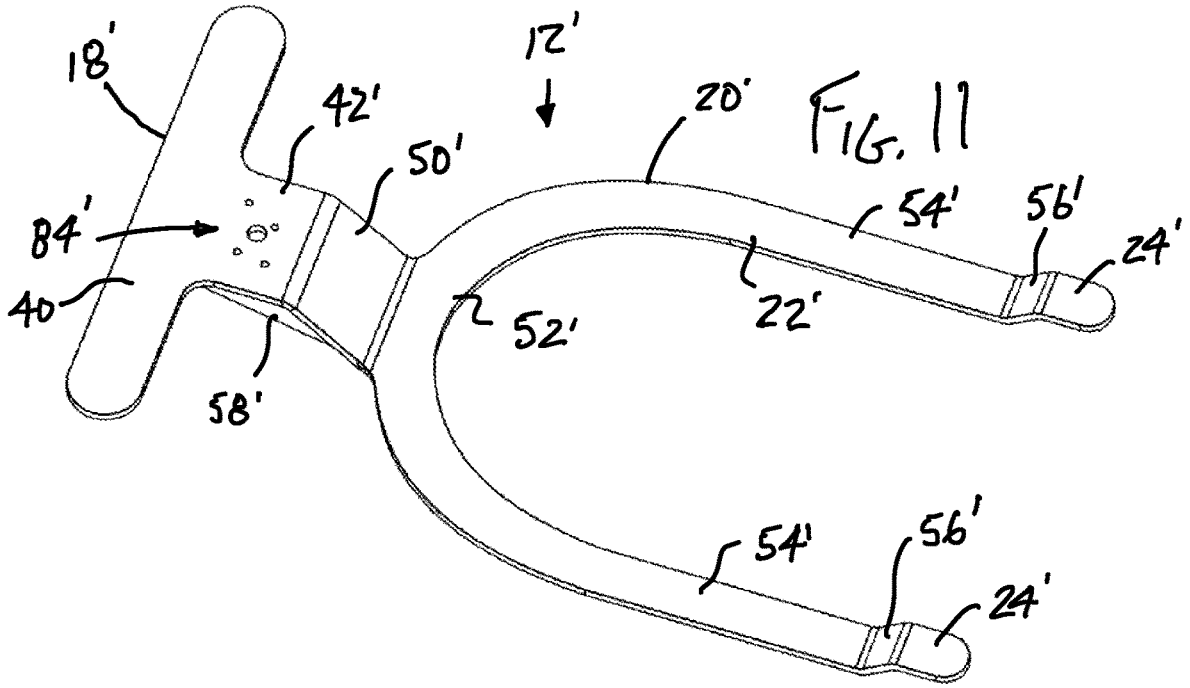
FIG. 11 is a top perspective view of an alternative base.
Figure 12:
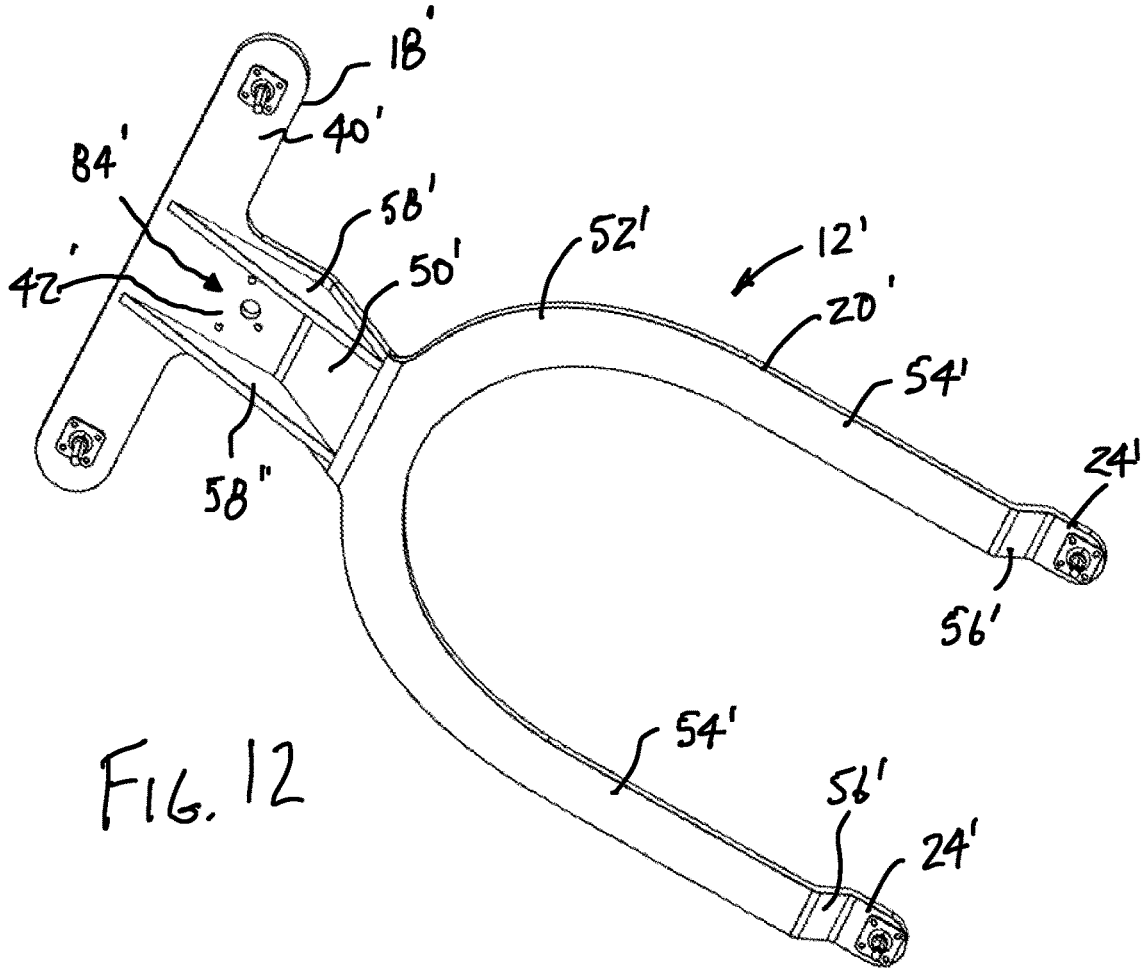
FIG. 12 is a bottom perspective view of the alternative base of FIG. 11.

To reinforce the base 12 and reduce the risk of bouncing/flexing and other undesirable movement, the wishbone-shaped extension 20 includes a support rib 58. In the illustrated embodiment, the support rib 58 is affixed to the transition segment 50 and at least one of the curved segment 52 and the longitudinal segment of the column-support portion 18. The illustrated support rib 58 is generally triangular in shape and is affixed in a vertical orientation to the top surface of the transition segment 50 and the top surface of the curved segment 52. While the illustrated embodiment includes a single support rib 58, the number of support ribs may vary from application to application. In alternative embodiments, the support rib 58 may be supplemented by or replaced with one or more support ribs affixed to the undersurface of the longitudinal segment of the column-support portion 18 and the undersurface of the transition segment 50. The number, size, shape and configuration of the support rib(s) may vary from application to application. The support rib may be replaced by other structures intended to reinforce the wishbone-shaped extension and/or its connection with the column-support portion 18, such as folds, bends or flanges formed in the transition segment 50 and/or adjacent portions of the base 12, or such as supplemental structure components that are affixed to the transition segment 50 and/or adjacent portions of the base 12. For example, FIGS. 11 and 12 show an alternative embodiment of the base 12' in which support rib 58 is replaced by a pair of support ribs 58'. FIGS. 11 and 12 use reference numerals that are identical to those used in FIGS. 1-10, except that the prime symbol ("") has been added to the end of each to signify that base 12' is an alternative embodiment. In addition to revised support ribs 58', the alternative embodiment of FIG. 11 is configured so that the column (not shown in FIGS. 11 and 12) mounts to the longitudinal segment 42' of the column-support portion 18'. More specifically, the mounting holes 84' for the column are approximately centered on the longitudinal segment 42'. It should be understood that the column mounting positions shown in base 12 and base 12' are merely exemplary and that the mounting position may vary in alternative implementations of the present invention.

In the illustrated embodiment, the longitudinal segment 42 of the column-support portion 18 and the transition segment 50 of the wishbone-shaped extension 20 cooperatively space the U-shaped portion away from the column 14 to create lateral gaps 80 that are configured to straddle legs and/or wheels situated at the corners of the patient bed. In the illustrated embodiment, the lateral gaps 80 are defined in part by the curved segment 52 of the U-shaped portion 22. As a result, the lateral gaps become increasingly wider away from the centerline of the base 12. The curved segment 52 also provide a curved surface that will help to shepherd the OBT 10 into place about the leg/corner wheels if somewhat misaligned during fore/aft movement of the OBT 10. The same curved surface will help to shepherd the OBT 10 around the leg/corner wheel if a user attempts to withdraw the OBT 10 from beneath the bed while it is straddling a leg/corner wheel. In the illustrated embodiment, the innermost end of the lateral gaps (adjacent the center of the base and denoted by A in FIG. 5) is about ⅕ to about ⅓ the overall length of the base 12 (denoted by A+B in FIG. 5). The size of the lateral gaps 80 adjacent the center of the base 12 (denoted by A in FIG. 5) may vary from application to application. For example, it may be about 7.25 inches, in a range of about 3-12 inches, or in a range of about 5-12 inches in different alternative embodiments. In other implementations, the longitudinal distance between the lateral segment 40 and the curved segment 52 (denoted by A in FIG. 5) is at least 6 inches and not more than 18 inches. Further, while the curved segment 52 facilitates interaction between the base 12 and the legs/corner wheels, the shape of the lateral gaps may vary from application to application. It should be noted that the position and depth of the longitudinal gap 82 (see FIGS. 8-10) created by the U-shaped portion 22 is also a function of the relative size of the various segments of the base 12, such as the length of the longitudinal segment 42, the transition segment 50, the curved segment 52, the linear segments 54, the secondary transition segments 56 and the secondary caster segments 24. For example, in the illustrated embodiment, the depth of the longitudinal gap 82 is approximately 27.475 inches. The depth of the longitudinal gap 82 may vary from application to application, such as in a range of about 22 inches to about 28 inches and in a range of about 18 inches to about 36 inches.

FIGS. 8-11 illustrate some key functions of the OBT 10 by showing the interrelationship between the base 12 and the under-bed wheel W or the legs/corner wheels C for a typical patient bed B configuration. These examples are merely exemplary and it should be understood that the position of under-bed wheels can vary between different models, types and styles of patient beds. The design and configuration of the present invention has been selected to work with many, if not all, currently available patient beds that incorporate under-bed wheels, but the design and configuration may be tuned to provide enhanced performance with alternative bed constructions. As noted above, FIG. 8 is a representative view showing the illustrated base 12 positioned beneath a representative patient bed B with an under-bed wheel W and four legs/corner wheels C located toward the four corners of the patient bed B. In the fully inserted position, the secondary caster segments 24 are positioned inwardly beyond the under-bed wheel W, which allows the OBT 10 to move freely relative to the bed B in the fore and aft direction (as denoted by Arrow M1 in FIG. 8). This is permitted because the central region of the U-shaped portion has a low enough profile to pass under the raised under-bed wheel W without interference. It should be understood that this spacing is primarily a function of the physical characteristics of the various segments of the base 12. These characteristics may be varied to provide the desired inward spacing of the secondary caster segments 24 depending, for example, on the position of the under-bed wheel(s) and other under-bed structures that might present interference issues. Further, the deep U-shaped longitudinal gap 82 in the base 12 also the OBT 10 to function when the under-bed wheel W is engaged with the ground or is not raised high enough to provide clearance for the low-profile region of the U-shaped portion. For example, with reference again to FIG. 8, regardless of whether the under-bed wheel W is raised or lowered, the OBT 10 can be moved into and removed from the illustrated position a direction perpendicular to the direction denoted by arrow M1.

Figure 8:
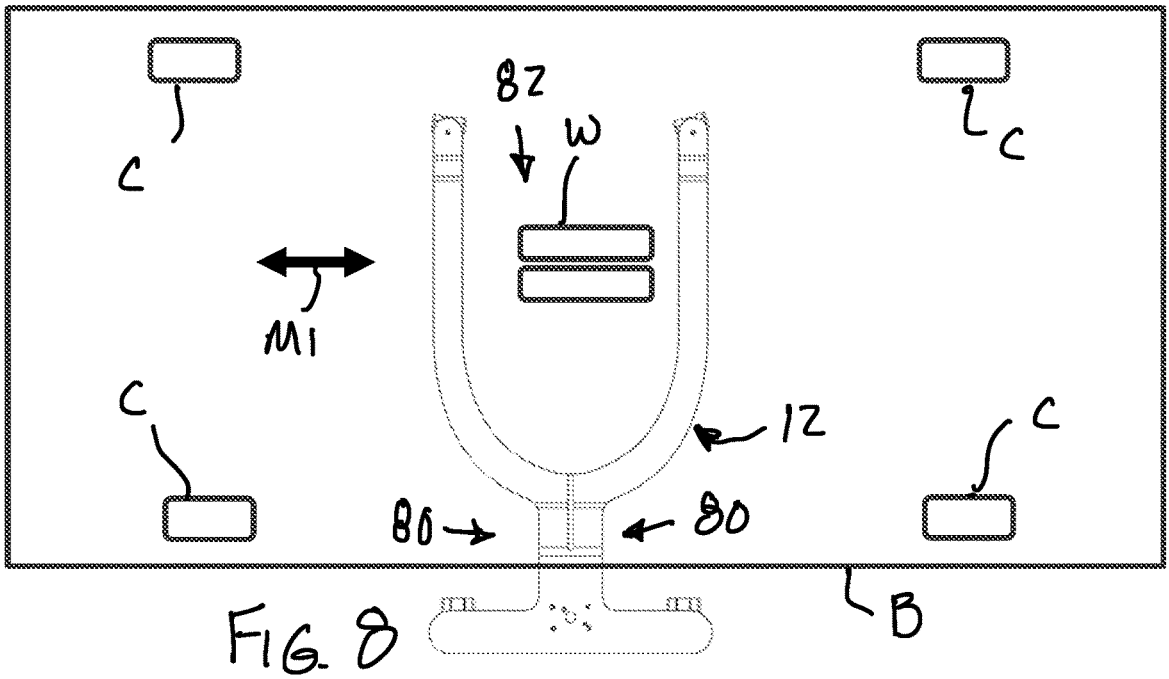
FIG. 8 is a representational view showing the base positioned with respect to a raised under-bed wheel of a patient bed.
Figure 9:
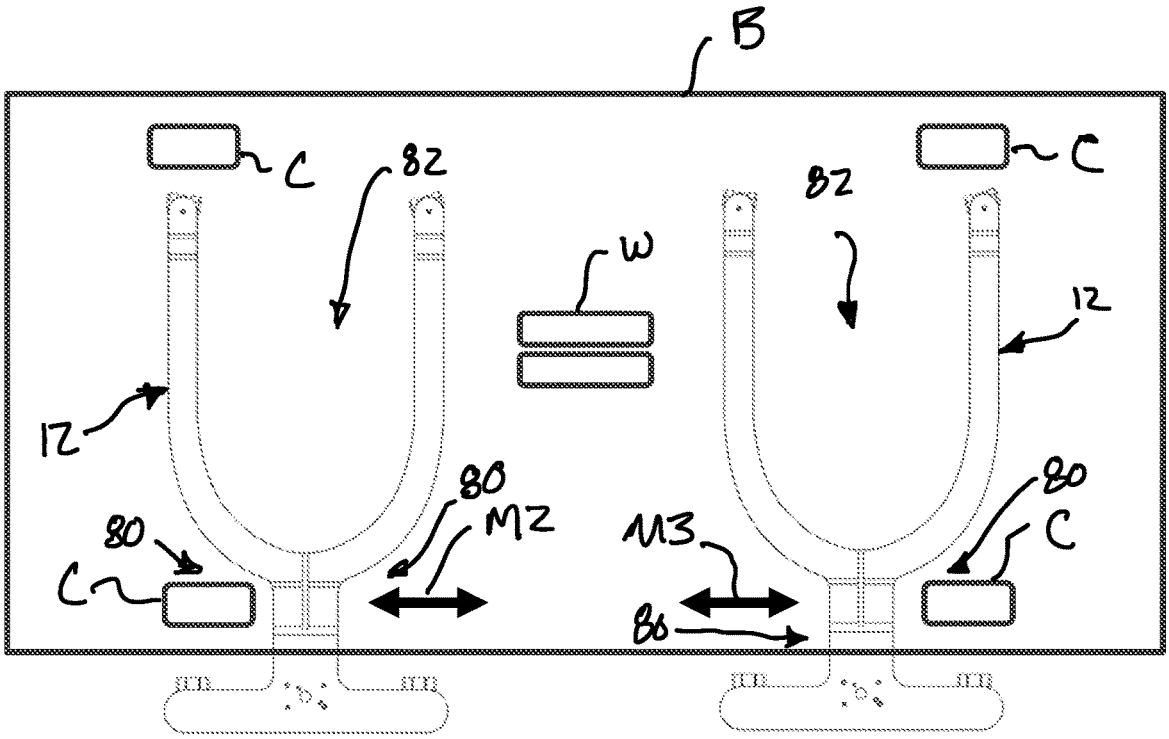
FIG. 9 is a representational view showing two different bases positioned adjacent a first and second corner legs/corner wheels of the bed.

FIG. 9 is a representational view similar to FIG. 8 showing the illustrated base 12 adjacent to the two of the legs/corner wheels C. As shown, the lateral gaps 80 are configured to receive a leg/corner wheel C when the OBT 10 is fully inserted over the bed B. This allows the OBT 10 to be moved farther in the fore-aft direction (as denoted by arrows M2 and M3 in FIG. 9) than would otherwise be possible. Additionally, the curved segment 52 provides a curved edge facilitates movement of the base 12 relative to the legs/corner wheels C. For example, if the OBT 10 is not fully inserted under the bed B, fore-aft movement of the OBT 10 might result in a leg/corner wheel C abutting the curved edge such that further fore-aft movement in the same direction will urge the OBT 10 farther under the bed B. As another example, if a user attempts to withdraw the OBT 10 from beneath the bed B when a leg/corner wheel C is received in a lateral gap 80, the curved edge will engage the leg/corner wheel C and will help to guide the base 12 around the leg/corner wheel.

Figure 10:
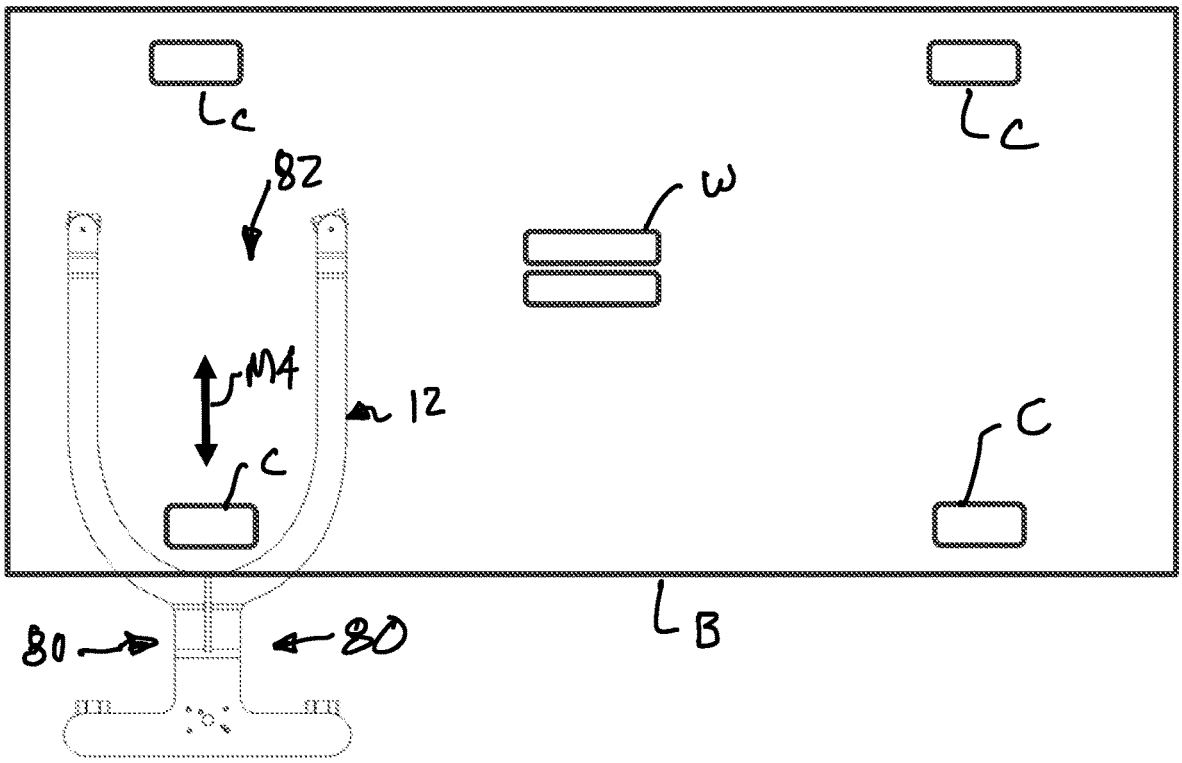
FIG. 10 is a representational view showing the base positioned with the U-shaped portion straddling a corner leg/corner wheel of the bed.

FIG. 10 is another representational view similar to FIGS. 8 and 9 showing how the base 12 is optimized to provide enhanced interaction with patient beds. In this illustration, the OBT 10 is positioned with the U-shaped portion 20 straddling a leg/corner wheel C. This position may be particularly useful for stowing the OBT 10 when it is not in use. As shown, the leg/corner wheel C is positioned within longitudinal gap 82. The depth of the longitudinal gap 82 (in the direction denoted by arrow M4) is helpful in reducing how far the OBT 10 extends from the bed B when stowed in this position. As can be seen, the base 12 of the illustrated embodiment is configured to optimize performance not only with respect to under-bed wheels (and similar under-bed structure) that have low clearance, but also with legs/corner wheels that generally remain engaged with the ground and have no under-clearance.

In the illustrated embodiment, the lateral segment 40 of the column-support portion 18 has an upper surface with a height of about 2 inches above the floor. The height may vary, however, from application to application. Given that the lateral segment does not pass under the patient bed B, the height of lateral segment can be selected largely without concern for engagement with an under-bed wheel or the legs/corner wheels.

As noted above, the column 14 is mounted to the base 12. In this embodiment, the column 20 is affixed to the base 12 by fasteners (not shown) that extend up through holes in the base 12 into corresponding screw bosses integrated into the lower section of the column 20. This mounting structure is merely exemplary and the column 14 may be mounted to the base 12 using essentially any suitable mounting structure capable to securing the column 14 to the base 12, such as welding, fasteners, clamping mechanism, post and seats just to name a few alternative options.

Although not shown, table top 16 may be mounted to the column 14 using essentially any suitable mounting structure. For example, a mounting plate 17 may be affixed to the column 20, and the table top 16 can be affixed to the mounting plate 17 by fasteners. In one embodiment, the mounting plate may be joined to the column 14 by welding or by fasteners. It should be understood that the described table top mounting structure is merely exemplary and that the present invention may be incorporated into OBT that utilize any table top mounting structure.

The OBT 10 of the illustrated embodiment includes primary casters 26 that support the outer end of the base 12 (i.e. the end that supports the column 14 and does not extend under the bed) and secondary casters 28 that support the inner end of the base 12 (i.e. the end that is intended to be fitted under the bed). In this embodiment, primary casters 26 are secured to the undersurfaces of each of the lateral segment 40 of the column-support portion. More specifically, in this embodiment, caster mounts are affixed by fasteners to undersurface of the lateral segment 40 and the undersurfaces of the secondary caster segments 24. The caster mounts may, however, be secured to the wings using any suitable attachment, such as welding. In this embodiment, the primary casters 26 are substantially larger than the secondary casters 28. In alternative embodiments, the casters 70 need not vary is size, but may instead be identical. For example, the base 12 may be configured to place the secondary caster segments 24 at the same height as the lateral segment 80 so that four identical casters might be used. In the illustrated embodiment, the primary casters 26 and secondary casters 28 are selected to support the base 12 with the low profile central region positioned about ⅜" above the floor. In this embodiment, the primary casters 26 have a diameter of about 75 millimeters and secondary casters have a diameter of about 36 millimeters. The caster sizes can, however, be varied from application to application as desired. The illustrated casters 70 are merely exemplary, and the base 12 may be fitted with alternative casters, or with wheels, rollers or other rolling components. For purposes of this disclosure, the term "caster" is intended to encompass all types of rolling components, including without limitation casters, wheels, and rollers.

Figure 13:
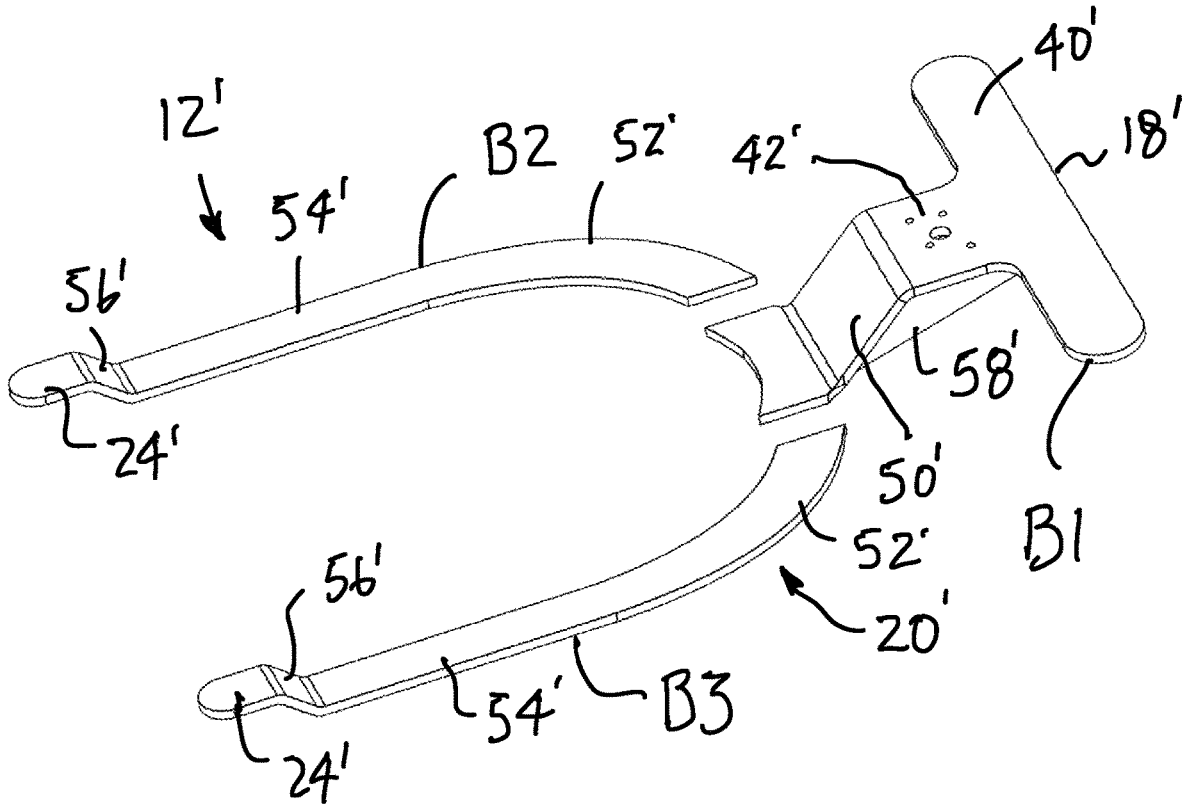
FIG. 13 is an exploded perspective view of the base.

In the illustrated embodiment, the base 12 is manufactured from an assembly of several component parts, each fabricated from sheet or plate stock. For example, as shown in FIG. 13, the column-support portion 18 and a central portion of the wishbone-shaped extension 20 are formed together from a single "T"-shaped blank B1 and the opposite legs of the U-shaped segment 52 are formed from a pair of separate curved blanks B2 and B3. This configuration of blanks help to reduce waste. For example, the curved blanks B2 and B3 can be closely nested creating very little waste. In this embodiment, the curved blanks B2 and B3 are identical and the forming step converts them into left or right side curved portions. As another example, the "T"-shaped blanks can be arranged in an alternating pattern that creates rectangular remnants that can be cut to form the gussets or support ribs 58, 58'. Each of the blanks B1, B2 and B3 are formed from a single piece of sheet or plate stock, such as by laser cutting, plasma cutting, waterjet cutting, CNC mills/machine tools or any other manner of cutting or machining of the stock to arrive that the desired shape. In one implementation, planar preforms are cut from sheet or plate stock. In one embodiment, the preform is cut from about ⅜" plate, but the thickness may vary from application to application, such as in the range of about ¼" to about ½". After cutting, each preform may be bent or otherwise formed to arrive at the desired three-dimensional shape as described above. Bending and other shaping operations may be performed using conventional presses, brakes and other metal forming equipment to achieve the design and function as described herein and shown in the drawings. Once shaped, the blanks B1, B2 and B3 are joined together, for example, by welding. The manufacturing process could and may vary. Metal and or plastics may be used as well as stamping, forging, casting, injection molding, sintered materials, additive printing methodologies and any other manner of forming or manufacturing such product. As an alternative, the base 12 may be formed essentially from a one-piece unitary structure fabricated from sheet or plate stock.

The configuration of the base 12, including the column-support portion 18 and wishbone-shaped extension 20, can vary, particularly as newly designed and released beds come to market. For example, the relative size of the column-support portion 18 and the wishbone-shaped extension 20, as well as the precise size and shape of the various segments of the base 12 may vary from application. The configuration of the base 12 may vary to provide enhanced performance with different types, styles and models of patient beds, whether it be different beds that are available on the market now or new beds that may be introduced in the future. If the position or number of under-bed wheel or legs/corner wheels vary, the dimensions and shape of the base 12 may be changed to accommodate the varied bed construction.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. An over bed table for use with a patient bed having an extendable and retractable under-bed wheel comprising:

a table top having first and second ends;

a column having a top and a bottom, the column extending vertically with the top coupled to the first end of the table top; and a base having first and second ends, the bottom of the column joined to the base toward the first end of the base, the base having a column-support portion and a wishbone-shaped extension, the column-support portion disposed toward a first end of the base and supported on primary casters, the column-support portion having an elevated profile with a height greater than a retracted height of an under-bed wheel, the wishbone-shaped extension extending from the column-support portion in an inward direction, the wishbone-shaped extension including a longitudinal segment and a U-shaped portion, the longitudinal segment extending in a longitudinal direction between an approximate center of the column-support portion and an approximate center of the U-shaped portion, the U-shaped portion having a low profile region with a height less than a retracted height of an under-bed wheel, the longitudinal segment laterally offsetting the U-shaped portion from the column-support portion such that the column-support portion and the longitudinal segment cooperatively define a pair of lateral gaps with one of the lateral gaps on each side of the base, the lateral gaps extending longitudinally alongside the longitudinal segment and being configured to laterally receive a corner structure of a patient bed, while simultaneously permitting the low profile region to pass beneath a retracted under-bed wheel, whereby the low profile region is able to pass below a retracted under-bed wheel, the U-shaped portion terminating in secondary caster segments, the secondary caster segments supported on secondary casters, the secondary caster segments having an elevated profile with a height of greater than a retracted height of an under-bed wheel.

2. The over bed table of claim 1 wherein the column-support portion is generally T-shaped with a lateral segment and a longitudinal segment.

3. The over bed table of claim 1 wherein the longitudinal segment of the base is a transition segment joining the elevated column-support portion with the low profile region of the U-shaped portion.

4. The over bed table of claim 3 wherein the longitudinal segment of the base extends at a transition angle of between about 5 degrees to about 60 degrees relative to a horizontal plane.

5. The over bed table of claim 4 wherein the base includes a support rib coupled to the transition segment.

6. The over bed table of claim 4 wherein the base includes a vertical support rib coupled to the transition segment and the curved segment of the U-shaped portion.

7. The over bed table of claim 1 wherein the U-shaped portion includes a curved segment and a pair of linear segments, the curved segment and the linear segments each having a low profile with a height less than a retracted height of an under-bed wheel, whereby the curved segment and the linear segments are able to pass below a retracted under-bed wheel.

8. The over bed table of claim 7 wherein the curved segment is semicircular.

9. The over bed table of claim 8 wherein each linear segment is joined to one of the secondary caster segments.

10. The over bed table of claim 9 wherein the primary casters have a diameter of at least 1 inch and the secondary casters have a diameter of no more than ¾ inch.

11. The over bed table of claim 1 wherein the base is assembled from a "T"-shaped blank and a pair of mirror-image curved blanks.

12. The over bed table of claim 2 wherein the U-shaped portion is spaced apart from the lateral segment of the column-support portion by a distance of at least five inches and no more than twelve inches.

13. A base for an over bed table intended for use with a patient bed having corner structures that engage a floor and an extendable and retractable under-bed wheel comprising:

a column-support portion adapted to receive and support a column and a table top, the column supporting portion including a lateral segment extending laterally across the base;

a pair of primary casters disposed beneath the column-support portion, the primary casters joined to the column-support portion toward opposite ends of the lateral segment of the column-support portion, the primary casters supporting the column-support portion at an elevated height greater than a retracted height of an under-bed wheel;

a wishbone-shaped extension extending from the column-support portion, the wishbone-shaped extension having a longitudinal segment and a U-shaped portion, the longitudinal segment of the wishbone-shaped extension having a longitudinal extent and joining the column-support portion and the U-shaped portion, the U-shaped portion including a curved segment and a pair of linear segments extending from opposite ends of the curved segment, the curved segment and the linear segments cooperatively defining a low profile region with a height less than a retracted height of an under-bed wheel, the base being configured such that the low profile region is aligned with an under-bed wheel when the base is fully inserted under a bed such that the base can be moved along a bed with the low profile region passing under a retracted under-bed wheel, the curved segment being longitudinally offset from the lateral segment of the column-support portion by a longitudinal offset, the U-shaped portion having a longitudinal extent at least three times the longitudinal offset, the column-support portion and the wishbone-shaped extension defining a pair of lateral gaps with one of the lateral gaps on each side of the base, the lateral gaps extending longitudinally alongside the longitudinal segment and being of sufficient longitudinal extent to straddle a corner structure of a patient bed, the lateral gaps being defined such that the low profile region remains unobstructed for passage beneath a retracted under-bed wheel, the U-shaped portion defining a central gap of sufficient lateral extent to straddle a corner structure of a patient bed;

a pair of secondary caster segments, each secondary caster segment extending from a corresponding one of the linear segments; and a pair of secondary casters disposed beneath the secondary caster segments, each of the secondary casters being joined to a corresponding one of the secondary caster segments.

14. The base of claim 13 wherein the column-support portion includes a longitudinal segment, the longitudinal segment extending from an approximate center of the lateral segment of the column-support portion.

15. The base of claim 14 wherein the longitudinal segment of the wishbone extension extends from the longitudinal segment of the column-support portion.

16. The base of claim 15 wherein at least one of the longitudinal segment of the column-support portion and the longitudinal segment of the wishbone extension is a transition segment extending from an elevated height of the column-support portion and the lower height of the low profile portion.

17. The base of claim 16 wherein the curved segment of the U-shaped portion is semicircular.

18. The base of claim 17 wherein the base is assembled from a "T"-shaped blank and a pair of mirror-image curved blanks, the blanks being separately cut, formed and joined together by welding.

* * * * *